US005153552A

United States Patent [19]

Krasser

[11] Patent Number: 5,153,552

[45] Date of Patent: Oct. 6, 1992

[54] THERMALLY TRIPPED CIRCUIT BREAKER WITH ADJUSTABLE TRIPPING SENSITIVITY

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 680,665

[22] Filed: Apr. 5, 1991

[30] Foreign Application Priority Data

Apr. 6, 1990 [DE] Fed. Rep. of Germany ... 9004031[U]
Dec. 21, 1990 [DE] Fed. Rep. of Germany ... 9017292[U]

[51] Int. Cl.[5] ..... H01H 71/16

[52] U.S. Cl. ..... 337/66; 337/74; 337/82

[58] Field of Search ..... 337/62, 63, 64, 65, 337/66, 67, 68, 69, 70, 71, 72, 73, 74, 75, 76, 77, 78, 79, 80, 81, 82, 83, 84, 85, 86, 87, 88, 89, 90, 91, 92, 93, 94

[56] References Cited

U.S. PATENT DOCUMENTS 3,265,832 8/1966 Powell .
4,044,325 8/1977 Krasser et al. ..... 337/66

FOREIGN PATENT DOCUMENTS 2502579 7/1976 Fed. Rep. of Germany .
2298878 8/1976 France .

*Primary Examiner*—Harold Broome
*Attorney, Agent, or Firm*—Spencer, Frank & Schneider

[57] ABSTRACT

A push button operated circuit breaker with thermal tripping by way of a bimetal strip includes an angled contact bridge which is mounted within a switch housing to be freely pivotal and is urged in a tripping direction by a tripping spring against a contact lug of the bimetal strip projecting laterally for engagement with a contact piece of the contact bridge. The circuit breaker further including a connecting arm which is coupled for movement with the bimetal strip. The cylindrical exterior surface of a drum-shaped rotary body lies against the connecting arm and thus creates a kinematic connection between the rotary body and the connecting arm. When the switch housing is fully assembled, the drum-shaped rotary body is operative as an adjustment eccentric which is externally manipulatable by way of a hexagonal recess so as to adjust the tripping characteristic of the circuit breaker.

25 Claims, 7 Drawing Sheets

THERMALLY TRIPPED CIRCUIT BREAKER WITH ADJUSTABLE TRIPPING SENSITIVITY

CROSS REFERENCE TO RELATED APPLICATIONS

The present application claims the rights of priority with respect to application Ser. Nos. G 90 04 031.7 and G 90 17 292.2 filed Apr. 6, 1990 and Dec. 21, 1990, respectively, in the Federal Republic of Germany, the subject matter of which is incorporated herein by reference.

BACKGROUND OF THE INVENTION

The invention relates to a thermally tripped circuit breaker switch which operates according to the principle of thermal tripping by means of a bimetal strip.

A switch of this type is disclosed, for example, in German Patent No. 2,502,579 and corresponding U.S. Pat. No. 4,044,325. The bimetal strip is here given an approximately right-angle bend and is supported with little play near the bend by two bead projections shaped to a switch housing. At an appropriate distance next to the bead projections, a contact lug is shaped to the bimetal strip so as to project laterally in the direction toward a contact piece of a right-angle contact bridge. In a turn-on position of the circuit breaker switch, a tripping spring urges the contact piece of the contact bridge against the contact lug. If an overcurrent occurs, the bimetal strip is heated to the extent that it is bent outwardly to release the contact bridge from the contact lug which is pushed back into its turn-off position by the force of a compression spring.

The tripping sensitivity of the switch is adjusted by way of an adjustment screw. The adjustment screw acts according to the principle of pull-push adjustment by way of a bias and deformation on a connecting arm fixed to the bimetal strip. The drawback of this adjustment is the lability of the adjustment screw in the end state of the adjustment. The biasing force acting on the screw changes over the adjustment range. Moreover, the biasing force acts only on the point in the center of the adjustment screw core.

This lability is disadvantageous because such circuit breakers are preferably installed as substitutes for conventional meltable fuses in the circuits of vehicles. Due to vehicle operation, the switch is subjected to varied use conditions. The switch must be able to withstand abrupt changes in climate and also extreme mechanical shock and vibration stresses. Particularly, if the biasing forces are low, such adjustment will not be able to handle these climatic and mechanical stresses.

Moreover, very little space is available for the installation of circuit breakers in vehicles, so that plug bases are provided into which such switches are inserted. For this purpose, the switches are provided with contact elements in the form of knife blade lugs. In order to be able to place as many as possible of such switches in juxtaposition in the closest space in a plug base, the individual switch must be configured as a very narrow structure. For reasons of space economy, the depth of the switch must be kept as low as possible for the same reason. The height of the switch, however, permits a little more leeway.

In the required, successively miniaturized configuration, these knife blade lugs lie very close to one another so that the space available between them for an adjustment screw is minimal. The adjustment screw itself, however, must not fall below certain dimensions, since it must be designed to handle the active biasing forces. Moreover, an external manipulation of the adjustment screw by, for example, a screwdriver, must be ensured. The size of the adjustment screw is thus a significant parameter which limits further miniaturization of such a switch.

Another drawback is that such adjustment screws are manufactured of metal and thus of conductive materials and, if they are placed between closely adjacent knife blade lugs, the danger of short circuits increases. The risk of damage to the knife blade lugs by the adjustment screw screwdriver also exists.

U.S. Pat. No. 3,265,832 discloses a bimetal controlled circuit breaker which is adjusted by way of an adjustment cam which charges the bimetal strip. For this purpose, the adjustment cam is externally adjustable. The drawback of this circuit breaker is the complicated overall structure composed of many individual parts.

SUMMARY OF THE INVENTION

It is an object of the present invention to improve a circuit breaker of the above-mentioned type and to adapt its overall structure to the requirements of automated manufacture.

The above and other objects of the invention are accomplished by the provision of a thermally trippable circuit breaker switch, comprising: a switch housing having a longitudinal axis, a narrow connection side and a lateral direction extending in the lengthwise direction of the narrow connection side perpendicular to the longitudinal axis; a bimetal strip disposed in the switch housing and constituting a tripping element; a connecting arm disposed in the switch housing and extending in the lateral direction of the switch housing, the connecting arm having a free end which is clamped into the switch housing, and the connecting arm being rigidly connected with the bimetal strip for acting as a lever arm for displacing the bimetal strip; two connecting contact elements projecting in parallel from the narrow connection side of the switch housing and extending at essentially a right angle to the connecting arm; and a rotary body made of insulating material for adjusting the tripping sensitivity of the bimetal strip, the rotary body having a cylindrical exterior surface which lies at the connecting arm and which includes a flattened portion to fix a zero position of the rotary body relative to the connecting arm, the rotary body being eccentrically rotatably mounted in the switch housing and including means for rotationally moving the rotary body from a location which is exterior of the switch housing, the rotary body lying in the switch housing without projecting therefrom and without enlarging the operative width of the switch housing, and the rotary body lying between the connecting contact elements and the connecting arm, the connecting contact elements having regions flanking the rotary body without contact, with the regions of the connecting contact elements flanking the rotary body being provided with recesses which reduce the width of the connecting contact elements.

The tripping mechanism of the switch according to the invention corresponds in principle to that of the switch disclosed in German Patent No. 2,502,579. However, the tripping sensitivity of the present switch is adjusted by way of a drum-shaped rotary body whose cylindrical exterior surface lies against the connecting arm.

The rotary body is mounted eccentrically around an axis of rotation within the switch housing and charges the connecting arm with a certain bias. Due to its eccentric mounting, its biasing force changes with the rotation of the rotary body. The connecting arm is deformed under the influence of the biasing force. The particularly kinematic connection of the connecting arm with the bimetal strip causes the deformation of the connecting arm to be transferred to the bimetal strip. The tripping characteristic which determines the tripping behavior of the circuit breaker is consequently changed so that the connecting arm and thus the bimetal strip experiences a defined preliminary deformation.

In the starting adjustment position, the flattened portion of the rotary body lies against the connecting arm in the tripping direction and is located at the smallest radial distance from the axis of rotation so that the rotary body acts on the connecting arm with a minimum biasing force. When installed, the flattened portion fixes the rotary body so that it is secure against rotation in the zero position.

The simple and always precisely defined zero position permits automated and thus particularly economical manufacture of the switch. If manufactured automatically by machine or by robot, the circuit breaker can initially be mounted completely automatically. In this case, it does not matter in which direction the rotary body is installed. At the end of the fabrication process, the rotary body is turned until a noticeable resistance has been overcome. After overcoming this resistance, the flattened portion of the rotary body lies against the connecting arm and has thus reached its zero position.

From this zero position, the bimetal strip is adjusted in a further step. By turning the rotary body, the radial distance of the region of the exterior surface in contact with the connecting arm from the axis of rotation increases so that the biasing force acting on the connecting arm increases continuously and reaches a maximum after a rotation of 180°.

The thus produced deformation of the bimetal strip causes the bias acting in the direction of the contact bridge in the region of the contact lug to drop and thus to increase its tripping sensitivity. In operation, this increase in tripping sensitivity results in a reduction of the maximum tripping time.

Due to the fixedly supported attachment of the connecting arm in the switch housing and the use of an adjustment eccentric-like rotary body, high biasing forces can be transferred to the connecting arm and thus to the bimetal strip. With the aid of a large rotary body diameter it is possible to configure the switch so that its tripping characteristic is adjustable over a large interval. Another advantage is the infinite adjustability by means of the adjustment eccentric.

Due to the fact that the adjustment eccentric cannot be manipulated from the connection end of the switch but rather the rotary body is adjusted from the sides of the housing, the connecting contact elements can be placed in very close proximity of one another.

The support of the rotary body in the switch housing between the connecting contact elements enhances the compact configuration of the switch. Moreover, with components configured according to the invention, it is possible to design the switch to be narrow in the horizontal direction and to make the width of its narrow side, which extends in the fixing direction, very flat.

The connecting contact elements flank the rotary body and, together with their recesses, form an installation trough for the rotary body. This enlarges the installation space for the rotary body. In regions not flanking the rotary body, the connecting contact elements are made broader in the horizontal direction in order to offer large contacting surfaces in the regions projecting from the switch housing to establish connections in the connecting sleeves of the plug bases.

The provision of spring hooks projecting from the connection side of the switch housing and flanking the outer longitudinal sides of the connecting contact elements according to a further aspect of the invention ensures a particularly reliable and durable latching of the switch in a plug base during the stress-intensive use in a motor vehicle.

Further features of the invention provide for a particularly favorable configuration of the entire switch mechanism from a functional standpoint in that a switch configured according to the invention extends vertically upward, enhancing the space saving design in the horizontal direction and in the direction of the narrow sides.

Due to a great distance in the horizontal direction between the connecting surface of the connecting arm with the bimetal strip and the support of the bimetal strip at the bead projections, there results a relatively long adjustment lever arm for the bimetal strip so that its easy and precise adjustment is enhanced. Moreover, the configuration of the bimetal strip in connection with its shaped on contact lug causes high tensile force components to occur with simultaneous low bending force components at the bimetal strip so that the bimetal strip is treated gently in use.

A one-piece configuration of the contact bridge, a supporting base and push button switch as a component group is advantageously favorable for automatic fabrication of the switch. The prefabricated component group can be installed in the switch by means of a single process phase by inserting it into one of the two half shells forming the switch housing. The use of such component groups enhances a modular, building-block type configuration of the switch. Additionally it is possible to pre-fabricate the component group in large numbers with unchanging high manufacturing precision.

According to yet further aspects of the invention the switch housing is given an advantageous configuration, with the aid of which the installable components are supported in the switch housing in a particularly advantageous manner. These favorable support characteristics are further influenced in a favorable manner by a one-piece configuration of the connecting arm and the bimetal strip on the one side and the connecting arm, one connecting contact element and one spring hook on the other side. Due to the one-piece con figuration, the stated components cooperate mechanically as well as electrically in a very secure and reliable manner. Moreover, the one-piece configuration of the mentioned components is structurally very simple and thus favorable from a manufacturing technology point of view.

Due to a multiple, form-locking support of the one-piece component group composed of at least the connecting arm, one of the connecting contact elements and an adjacent spring hook, it is possible to fix the component group in the housing simply by inserting it into one of the housing half shells. This advantageously enhances the automated installability of the switch according to the invention. Moreover, the multiple support of the one-piece component group enhances the operational reliability and service life of the switch. Due to this durable support, particularly of the connecting arm, particularly high forces can be transferred by the rotary body to the connecting arm. Consequently, the multiple supports in the switch are also suitable to absorb very high biasing forces that act on the connecting arm.

Moreover, by providing cheeks projecting from one of the housing half shells to secure a free end of the connecting arm, a rib shaped to one of the housing half shells and disposed between the connecting contact element and the spring hook of the one-piece component group, a trough-like receptacle for the rotary body shaped into the housing half shells, and bead projections shaped to a housing half shell for securing the bimetal strip, the deformation acting on the bimetal strip is controllable with particular precision. Thus the bimetal strip can be positively deformed by the rotary body.

By virtue of further advantageous aspects of the invention, it possible to injection mold the switch housing and the supporting elements shaped thereunto of plastic. Any errors due to manufacturing tolerances occurring during the plastic injection molding process can be easily compensated in a switch of this embodiment by a subsequent adjustment movement of the rotary body which is configured as a disk-shaped adjustment eccentric. Due to its infinite adjustability, it is thus possible to compensate for errors due to manufacturing tolerances as well as to set the desired tripping characteristic.

According to an advantageous embodiment of the invention, the rotary body has two end faces, each having a pivot pin projecting therefrom so that the longitudinal center axis of the pivot pins is congruent with the rotation axis of the rotary body. These pivot pins, which are preferably cylindrical, thus support the rotary body eccentrically in the switch housing. For this purpose, bearing eyes are shaped into the housing through which pass the pivot pins. By way of recesses built into the end faces of the pivot pins, particularly in the form of a hexagon socket, the rotary body can be manipulated from outside the assembled switch housing. The rotary body is thus an adjustment eccentric which acts on the connecting arm.

In a further embodiment of the invention, the pivot pins have an essentially star-shaped cross-sectional shape. The exterior surfaces of the pivot pins are provided with teeth which correspond to this star-shaped cross-sectional shape. In this embodiment, a detent or lug is provided at the bearing eyes so as to mesh with the teeth on the exterior surface of the pivot pins and engage in them. Due to this form-locking engagement in the teeth, the rotary body is additionally mechanically secured against rotation out of its respective relative position.

A particular advantage of the present invention is that the force vector acting between the connecting arm and the adjustment eccentric always perpendicularly intersects the rotation axis of the adjustment eccentric. Consequently, the effective direction of this force on the rotation axis is constant.

The biasing force acting between the connecting arm and the adjustment eccentric not only deforms the connecting arm but also secures the respective position of the adjustment eccentric by self-locking. This particularly advantageous effect prevents inadvertent rotation of the eccentric due to vibration or shock influences.

The position of the eccentric between the connecting contact elements and outside of the plug-in region in which the connecting contact elements are configured as knife blade lugs is particularly advantageous. The external hexagon key preferably employed to manipulate the adjustment eccentric does not come in contact with current-carrying components, particularly the knife blade lugs. Damage to the knife blade lugs during the adjustment is thus impossible right from the start.

To further miniaturize the circuit breaker switch of the invention, the adjustment eccentric is preferably configured as a narrow, space saving disc. Due to the above-described vertical path of the force vector through the axis of rotation of the rotary body, the resulting forces can still be absorbed, even if the embodiment is extremely narrow, so that the desired self-lock is always maintained.

According to another advantageous embodiment of the invention, the bimetal strip is configured as a meander shaped bimetal. In such an embodiment, several bimetal strips lie next to one another and are electrically connected in series, so that a relatively high resistance is realized. In circuits carrying relatively small resulting currents or with low current intensities, this enlarged resistance surface of the bimetal strip easily produces the heating power required for thermal tripping. To realize the same mechanical behavior as for a one-piece bimetal strip, the juxtaposed bimetal strips are preferably held together in the manner of a bandage by means of a clamp that grips around them.

The invention will be described in greater detail with reference to embodiments thereof that are illustrated in the drawing figures.

DETAILED DESCRIPTION OF PREFERRED EMBODIMENTS

Figure 1:
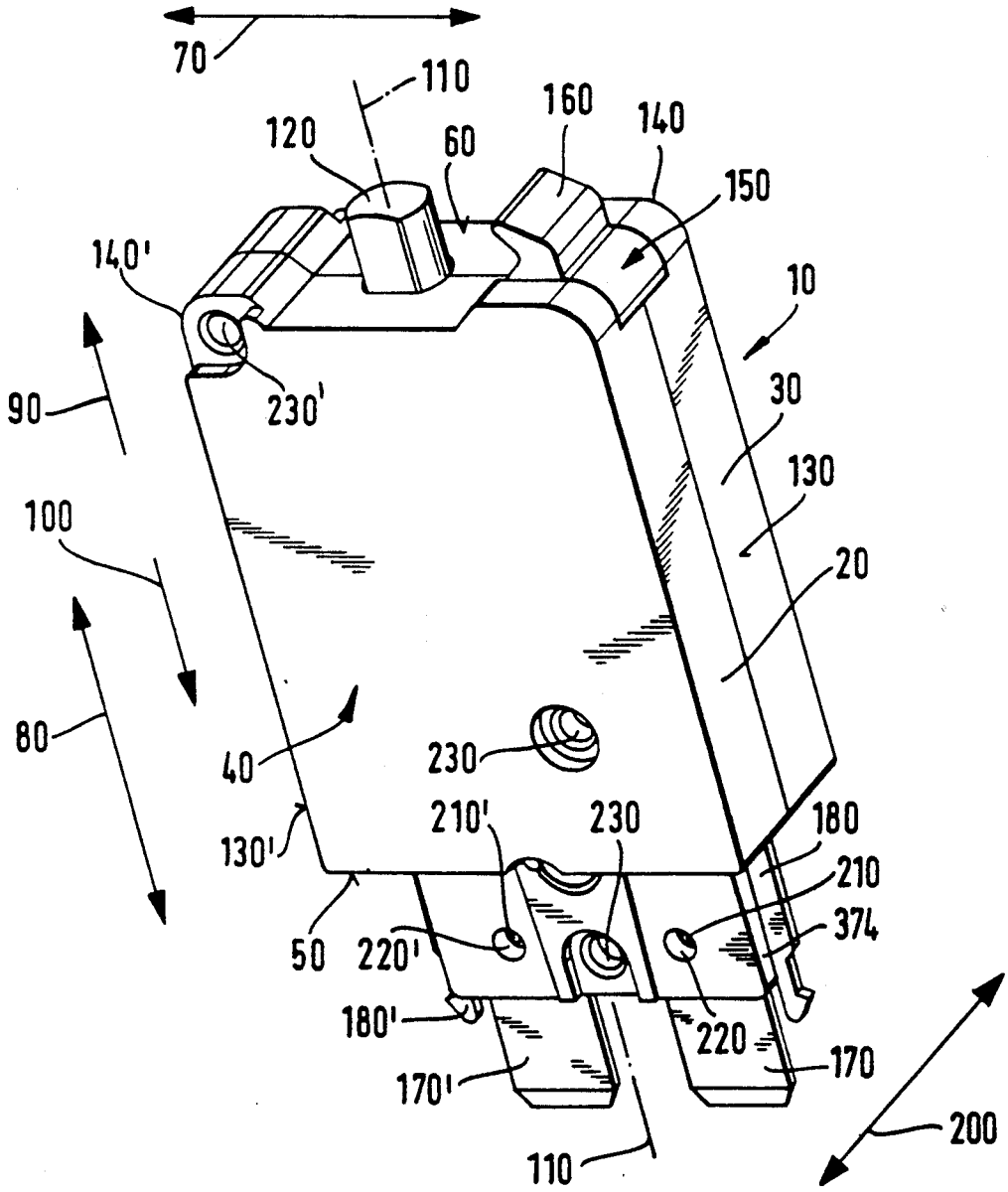
FIG. 1 shows an overall perspective view of a circuit breaker switch of the invention in the assembled state.

Referring to FIG. 1, there is shown a circuit breaker switch 10 which includes a switch housing 40 composed of an upper half shell 20 and a lower half shell 30. Switch housing 40 has a lower narrow side or connection side 50 and an upper narrow side or switch side 60 which faces away from connection side 50. Connection side 50 and switch side 60 extend parallel to the horizontal (lateral) direction 70. The vertical direction 80 (i.e. the direction of center longitudinal axis 110) is perpendicular to the horizontal direction 70. Circuit breaker switch 10 has a tripping direction 90 parallel to vertical direction 8 and extending in the direction toward switch side 60 and a turn-on direction 100 extending in the opposite direction toward connection side 50.

A push button 120 projects in tripping direction 90 from switch side 60, which extends in the vertical direction 80 approximately on center longitudinal axis 110 of circuit breaker 10. The connection side 50 and the switch side 60 are connected with one another in the vertical direction 80 by two narrow sides of switch housing 40, namely, right narrow side 130 and left narrow side 130' as view in the drawing figures. A knob 160 shaped to a manual tripper 150 projects from an edge region 140 formed by switch side 60 and the adjacent right narrow side 130.

A right connecting contact element 170 and a left contact element 170' project from connection side 50 in turn-on direction 100. The two connecting contact elements are configured as knife blade lugs and lie next to one another in horizontal direction 70 symmetrically to center longitudinal axis 110. Spring hooks 180, 180' for fixing the circuit breaker 10 in a plug base are shaped to the respective outer longitudinal sides of connecting contact elements 170, 170'. Connecting contact elements 170, 170' are each penetrated by a fixing hole 190, 190' (see FIGS. 2 to 5) in a direction perpendicular to horizontal direction 70 and in a fixing direction 200 that is also perpendicular to vertical direction 80. In the region of connection side 50, two fixing nubs 210, 210' project in fixing direction 200 from lower half shell 30 so as to face upper half shell 20. In an assembled state of the switch housing, fixing nubs 210, 210' pass through fixing holes 190, 190' and engage in two fixing openings 220, 220', respectively, which extend in fixing direction 200 at connection side 50 of upper half shell 20 so as to fix connecting contact elements 170, 170' in switch housing 40.

Upper half shell 20 and lower half shell 30 are each penetrated by a rivet hole 230 which extends in fixing direction 200 at connection side 50, in horizontal direction 70 approximately in a line with fixing openings 220, 220' and fixing knobs 210, 210', respectively. The left edge region 140' formed by the left narrow side 130' and switch side 60 is also penetrated by a rivet hole 230' extending in fixing direction 200. The cohesion of upper half shell 20 and lower half shell 30 to form switch housing 40 is realized by rivets introduced into rivet holes 230, 230'.

A contact holder 240 (FIGS. 2 to 5) which in the installed position extends close to the interior of left narrow side 130' is shaped to left contact element 170' in tripping direction 90. A fixed contact 250 oriented in the direction toward the housing interior is configured at a free end of contact holder 240 where contact holder 240 projects in tripping direction 90. A pivot contact 260 of a vertical arm 270 of a pivotal contact bridge 280 lies against fixed contact 250 so as to be oriented in the direction toward left narrow side 130'. Contact bridge 280 itself is composed of vertical arm 270 which extends in vertical direction 80 and a horizontal arm 290 connected therewith at a right angle at its end oriented in tripping direction 90. The free end of horizontal arm 290 facing away from vertical arm 270 constitutes a contact piece 300.

A compression spring 310 extending approximately congruently with center longitudinal axis 110 in switch housing 40 directs its spring force in tripping direction 90 to press against the flat side of horizontal arm 290 facing toward connection side 50. In the turn-on position, horizontal arm 290 takes on a horizontal position which is parallel to horizontal direction 70.

The upper side of contact piece 300 where it faces switch side 60 lies against a contact lug 320 so that it is in engagement with the latter. Contact lug 320 is shaped to a bimetal strip 330 so as to project in the direction toward compression spring 310. Bimetal strip 330 has a long vertical portion 331 extending in vertical direction 80 along the interior of right narrow side 130 approximately from switch side 60 almost to connection side 50. This vertical portion 331 of bimetal strip 330 is followed, after an approximately right-angle bend 340, by a horizontal portion 332 of bimetal strip 330 which extends in horizontal direction 70. This horizontal portion 332 of bimetal strip 330 is supported with little play between two bead projections, namely a connection side bead projection 350 and a switch side bead projection 350', both shaped to housing 40.

The free end of the horizontal portion 332 of bimetal strip 330 disposed opposite the vertical portion 331 of bimetal strip 330 is provided with a short fastening leg 360 that is bent upward at a right-angle to extend approximately in vertical direction 80 and constitutes a connection surface for a corresponding connection surface of a fastening leg 370' bent upward in this region from a connecting arm 370.

Figure 2:
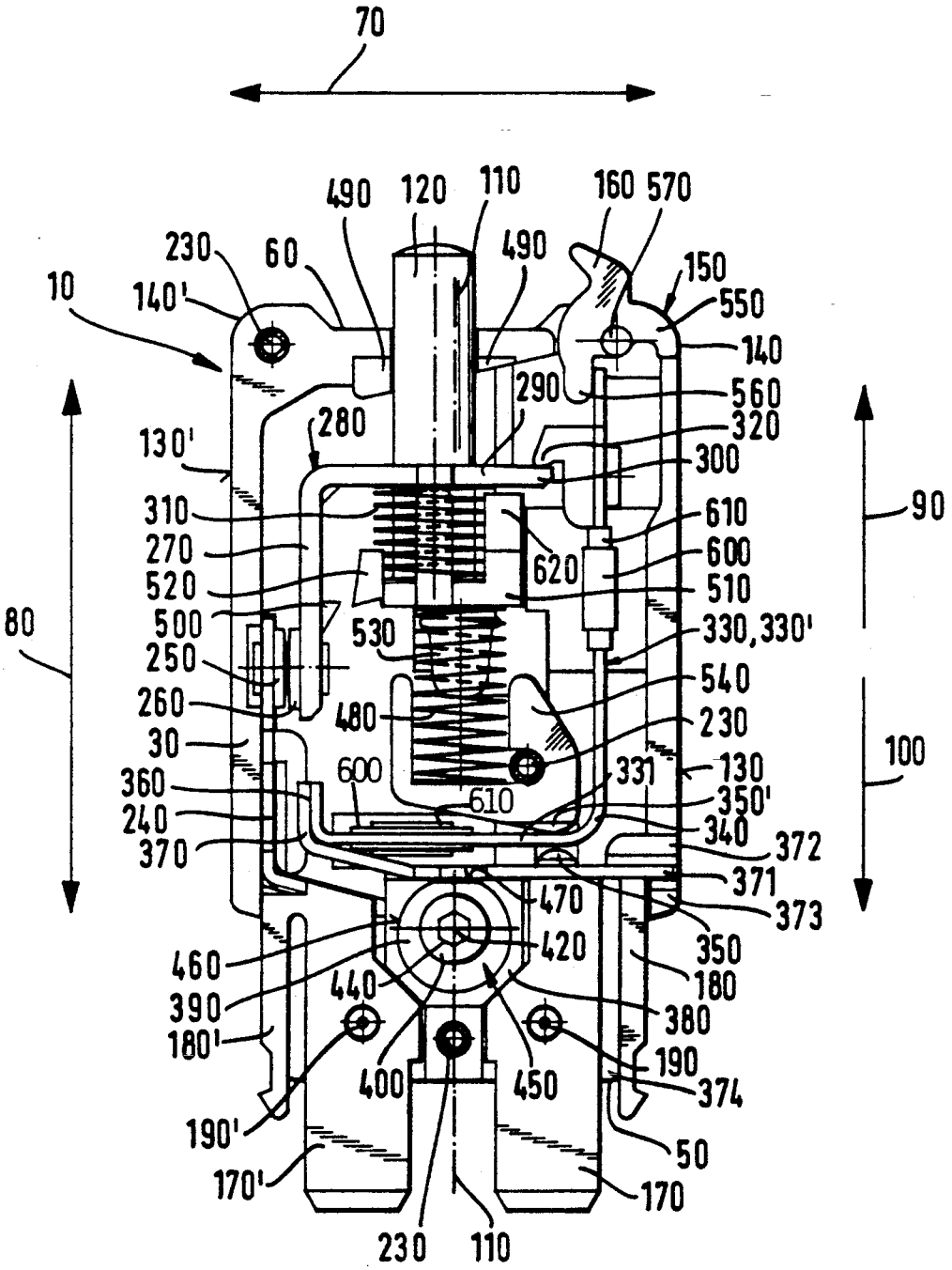
FIG. 2 shows an interior view of the circuit breaker switch of FIG. 1 in the turn-on position, with the upper half shell of the housing removed.

Consequently, seen in the plane of FIG. 2, bimetal strip 330 is essentially U-shaped, with its horizontal portion 332 forming a U-bar attached to vertical long U-leg 331 and to short fastening U-leg 360 that is bent upward at a right angle. The connection surface formed by short U-leg 360 is suitably fastened, for example by welding, to the corresponding connection surface of fastening leg 370' of connecting arm 370.

Connecting arm 370 extends from the connection surface with fastening leg 360 where it initially extends in vertical direction 80 and then obliquely to the horizontal direction toward connection side 50 and thereafter parallel to the latter in horizontal direction 70. When seen in turn-on direction 100, right connecting contact element 170, in the form of a knife blade lug, is shaped to contact arm 370 (see FIGS. 4 and 5).

Connecting arm 370 has a free end 371 opposite from fastening leg 370' which is supported by being clamped between a switch side cheek 372 and a connection side cheek 373. Between right spring hook 180 and right connecting contact element 170 there projects, when seen in fixing direction 200, a rib 374 which extends in vertical direction 80. Right connecting contact element 170, in turn, lies between rib 374 and the trough-shaped recess 380 so as to accommodate rotary body 390.

Connecting arm 370, right connecting contact element 170 and right spring hook 180 are configured as a one-piece $\pi$-shaped component, with connecting arm 370 forming the transverse yoke, and connecting contact element 170 and spring hook 180 forming the legs. This $\pi$-shaped component lies between bead projection 350 on the connection side, trough-shaped recess 380, rib 374 and cheeks 372, 373 so that cheek 373 on the connection side, rib 374 and trough-shaped recess 380 act as a form-locking fixed bearing against displacement of the $\pi$-shaped component in horizontal direction 70. The $\pi$-shaped component is secured against displacement in vertical direction 80 between cheeks 372, 373 and is supported at an end face 374' of rib 374 and an end face 380' of the trough-shaped recess 380 (see FIG. 5) as well as at connection side bead projection 350. The $\pi$-shaped component thus lies in a form-locking manner between cheeks 372, 373, rib 374 and the trough-shaped recess 380 as well as connection side bead projection 350.

Recess 380, which accommodates drum-shaped rotary body 390, extends in fixing direction 200 and is shaped into a part of connecting arm 370 extending between connecting contact elements 170, 170' and into half shells 20, 30 of switch housing 40. Cylindrical pivot pins 400 oriented in fixing direction 200 toward upper half shell 20 and lower half shell 30, respectively, projects from each one of the end faces of rotary body 390. Bearing eyes 410 are worked into upper half shell 20 and into lower half shell 30 in the region of recesses 380. These bearing eyes are oriented in fixing direction 200 and correspond in their cavity geometry to the volume geometry of pivot pins 400. Rotary body 390 is thus supported by way of its pivot pins 400 so as to be freely rotatable in bearing eyes 410.

In horizontal direction 70, pivot pins 400 have a circular cross section with a center at 420. In center point 420, both pivot pins 400 are intersected by an imaginary rotation axis 430 which extends parallel to fixing direction 200. In horizontal direction 70, rotary body 390 also has a circular cross section whose center, however, lies outside of center point 420 of pivot pins 400 so that the two center points are in no case congruent on one another. Rotary body 390 rotates, as do pivot pins 400, around rotation axis 430 which extends outside of the center of the rotary body, so that rotary body 390 performs eccentric rotary movements.

Together with a hexagonal recess 440 at the end face of each one of the two pivot pins 400, pivot pins 400 and rotary body 390 constitute an adjustment eccentric 450. Because of bearing eyes 410 which completely penetrate upper half shell 20 and lower half shell 30 in fixing direction 200, a hexagonal Inbus key can be inserted into hexagonal recesses 440 so as to manipulate adjustment eccentric 450.

Figure 7:
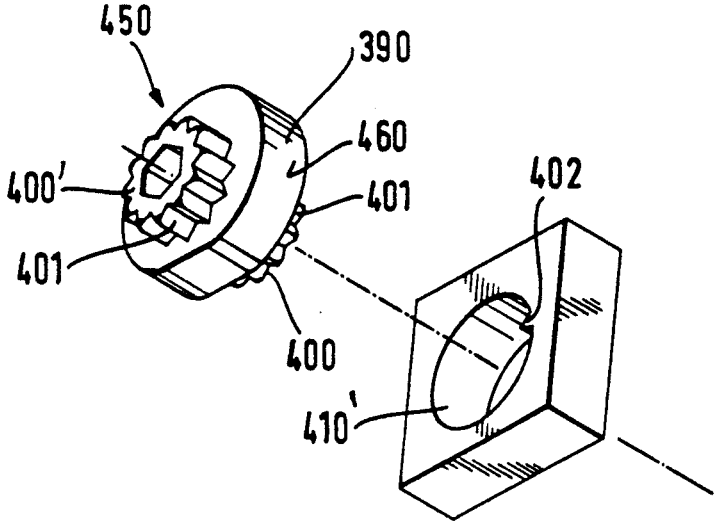
FIG. 7 is an exploded view showing another embodiment of the rotary body including a pivot pin provided with teeth.

A special embodiment of adjustment eccentric 450 shown in FIG. 7 is provided with modified pivot pins 400'. These modified pivot pins 400' are each equipped with teeth 401. Teeth 401 give an essentially star-shaped cross-sectional configuration to pivot pin 400' when seen in fixing direction 200. A separate embodiment of bearing eye 410' supplements the specially toothed embodiment of pivot pins 400'. A detent or lug 402 extending in horizontal direction 70 here projects into bearing eye 410'.

Detent 402 engages in teeth 401 so that teeth 401 are able to slide over detent 402 when adjustment eccentric 450 is rotated. On the other hand, the form-locking engagement of detent 402 in teeth 401 takes care of securing the position of adjustment eccentric 450 in its respective relative position. The parallel arrangement of detent 402 relative to connecting arm 370 ensures that adjustment eccentric is also raised in the adjustment direction and is not laterally displaced in horizontal direction 70.

Referring again to FIGS. 3 to 5, with one region of its exterior surface 460, adjustment eccentric 450 lies against connecting arm 370 and is kinematically connected with the latter. The region of exterior surface 460 which has the shortest radial distance from center point 420 is provided with a flattened portion 470 which extends parallel to connecting arm 370. If the flattened portion 470 of exterior surface 460 lies against connecting arm 370, adjustment eccentric 450 is in an installed position. In this installed position, the forces acting between adjustment eccentric 450 and connecting arm 370 are lowest. By turning adjustment eccentric 450 to the right clockwise, connecting arm 370 lies against one of the regions without a flattened portion 470 on exterior surface 460. The greater the radial distance between the region of exterior surface 460 lying at connecting arm 370 and the center point 420, the greater are the forces which act between connecting arm 370 and adjustment eccentric 450.

The adjustment of the tripping sensitivity of bimetal strip 330 is effected by way of the deformation of connecting arm 370 on the basis of the forces acting between connecting arm 370 and adjustment eccentric 450. Connecting arm 370 here transfers its deformation by way of the connecting surface with fastening leg 360 to bimetal strip 330 so that, with increasing force, the vertical portion of bimetal strip 330 is deformed in horizontal direction 70 in the direction toward the right narrow side 130.

Figure 3:
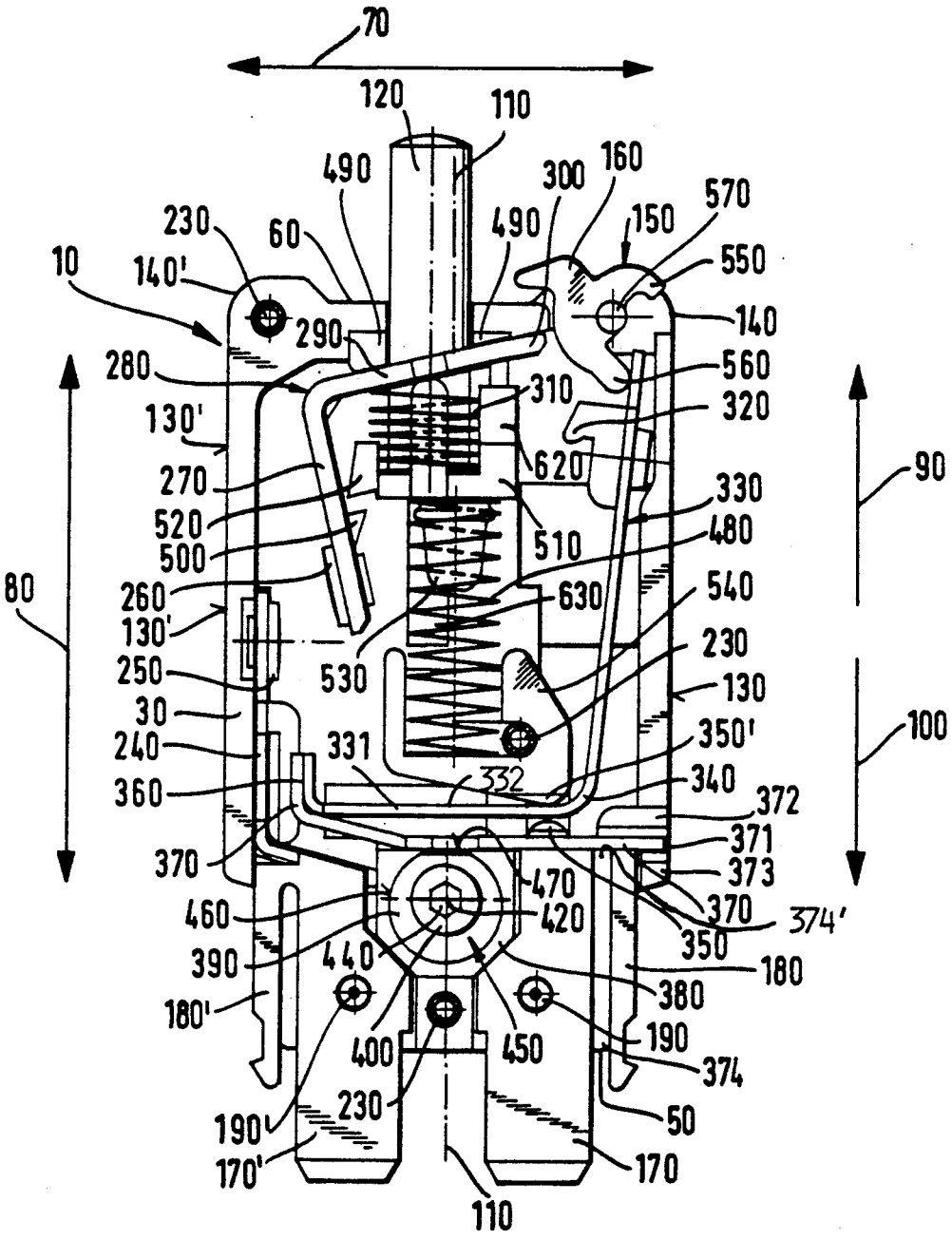
FIG. 3 shows an interior view of the circuit breaker switch of FIG. 1 in the turn-off position, with the upper half shell of the housing removed.
Figure 4:
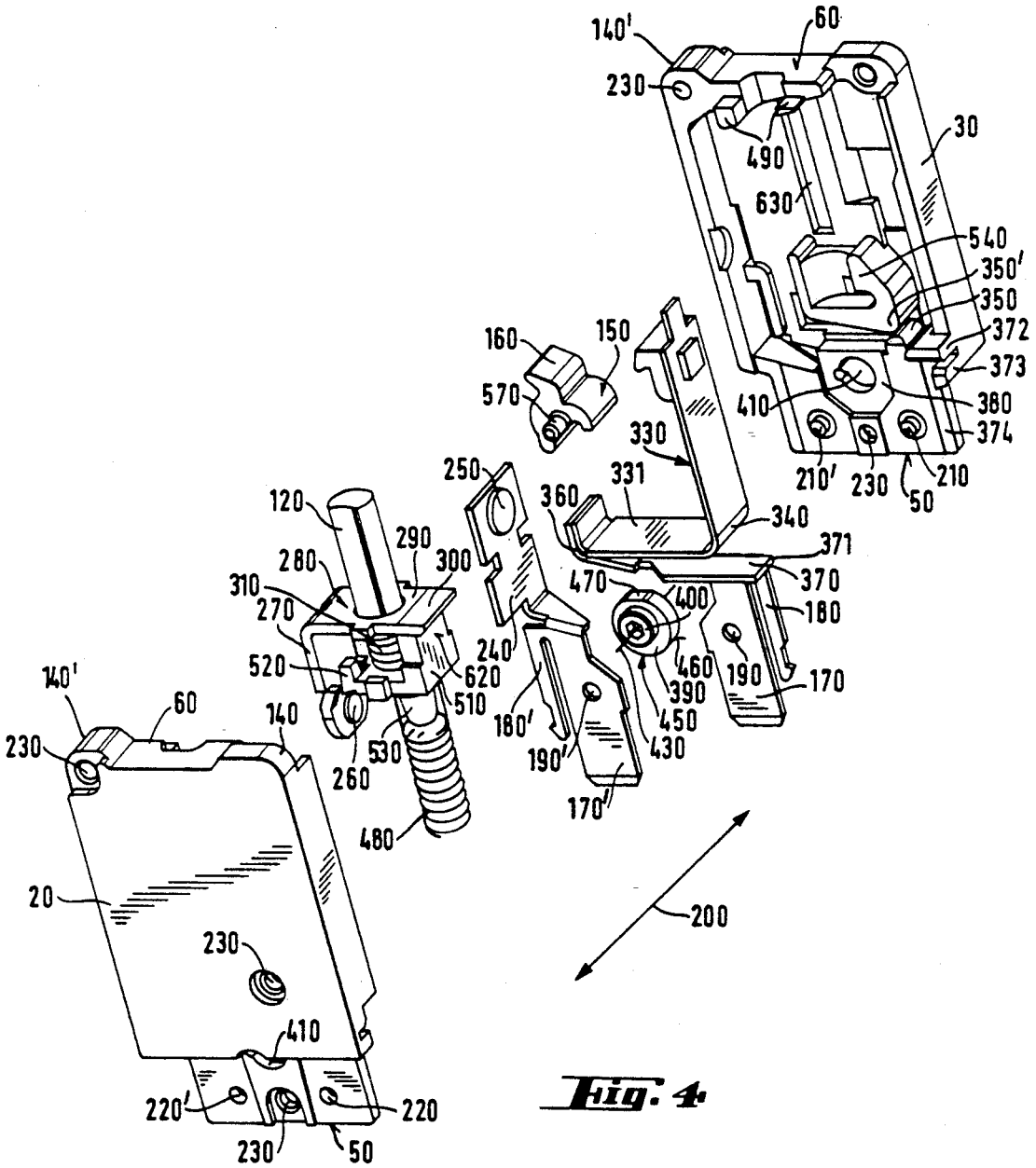
FIG. 4 shows an exploded view of an embodiment of the circuit breaker switch of FIG. 1 provided with normal, one-piece bimetal strip.

Thus, the overlap effective between contact piece 300 and contact lug 320 becomes smaller. If bimetal strip 330 is heated further, it is further deformed in horizontal direction 70 toward right narrow side 130, so that contact piece 300 and contact lug 320 come out of engagement (FIG. 3). If contact piece 300 and contact lug 320 are put out of engagement in this manner as a result of an occurring overcurrent, a tripping spring 480 which extends helically approximately around center longitudinal axis 110 acts to press contact bridge 280 in the manner of a catapult in tripping direction 90 toward switch side 60. At switch side 60, a sloped abutment 490 is formed in the interior of the housing so as to place contact bridge 280 into a sloped position in the turn-off state.

Tripping spring 480 is disposed between a supporting element 510 and a supporting base 540. By way of a centering stump 530 shaped on in the turn-on direction 100, supporting element 510 is connected with the free end of tripping spring 480 facing switch side 60. Centering stump 530 centers tripping spring 480 approximately about center longitudinal axis 110. Supporting element 510 thus lies between tripping spring 480 and a compression spring 310 which, in tripping direction 90, lies next to tripping spring 480. Supporting element 510 forms a one-piece component with push button 120, contact bridge 280, compression spring 310, and centering stump 530. This component is mounted to be movable in vertical direction 80 in path guides 630 shaped into half shells 20, 30 of switch housing 40.

In tripping direction 90, a shield 620 projects from supporting element 510 and acts in the direction toward right narrow side 130. Shield 620 shields compression spring 310 against an arc developing upon tripping between contact piece 300 and contact lug 320. Supporting base 540 is shaped into switch housing 40, preferably into lower half shell 30, and delimits tripping spring 480 in the direction toward connection side 50. Supporting base 540 has a U-shaped cross section extending in horizontal direction 70. The free side of the U is oriented in the direction toward switch side 60, and tripping spring 480 projects from it in tripping direction 90. In the direction toward connection side 50, the underside of supporting base 540 is provided with shaped-on bead projection 350' which supports bimetal strip 330. In fixing direction 200, supporting base 540 is penetrated by a rivet hole 230" (see FIGS. 2 and 3).

Above pivot contact 260, a safety stop 500 is provided on vertical arm 270 and projects in a direction toward the housing interior. Facing away from shield 620, a carrier 520 is shaped to supporting element 510 to face in the direction toward left narrow side 130'. The sloped orientation of contact bridge 280 at sloped abutment 490 causes carrier 520 and safety stop 500 to come into engagement in vertical direction 80 whenever push button 120 is depressed in turn-on direction 100 (see FIG. 3). In this way, contact bridge 280 is prevented from switching back, even if push button 120 is held down manually, so that the protective effect of circuit breaker 10 is ensured completely even if push button 120 has been depressed manually.

Only after bimetal strip 330 has shaped itself back into its starting position (FIG. 2) can the circuit breaker be brought back into the turn-on position. For this purpose, push button 120 is depressed in the turn-on direction 100. Upon release of push button 120, contact lug 320 and contact piece 300 return into engagement, thus straightening contact bridge 280 again, that is, its horizontal arm 290 extends parallel to horizontal direction 70 and carrier 520 and safety stop 500 go out of engagement.

In addition to the described overcurrent tripping, circuit breaker 10 also permits manual tripping. For this purpose, manual tripper 150 is provided with a pivot leg 550 which in the turn-on position extends parallel to horizontal direction 70 and an active leg in the form of a switching cam 560 which extends at a right angle thereto in vertical direction 80. Due to their being positioned at right angles to one another, switching cam 560 and pivot leg 550 form a toggle switch in the manner of a switching rocker.

A manual tripper 150 is supported in corresponding recesses in switch housing 40 by way of two bearing pins 570 which project from its end faces in fixing direction 200 to be pivotal in horizontal direction 70. With circuit breaker 10 in the turn-on position, a switching cam 560 shaped to tripper 150 lies in the manner of a finger against the free end of bimetal strip 330 which lies next to contact lug 320 when seen in the tripping direction 90.

Tripper 150 has a shaped on knob 160 which, if pressed in horizontal direction 70 toward push button 120, simultaneously moves switching cam 560 in horizontal direction 70 toward right narrow side 130 and, due to its finger-like contact, moves the vertical portion of bimetal strip 330 like a carrier in the direction of right narrow side 130. Contact lug 320 and contact piece 300 thus go out of engagement, causing tripping spring 480 to catapult contact bridge 280 in tripping direction 90 into its turn-off position according to FIG. 3.

Figure 5:
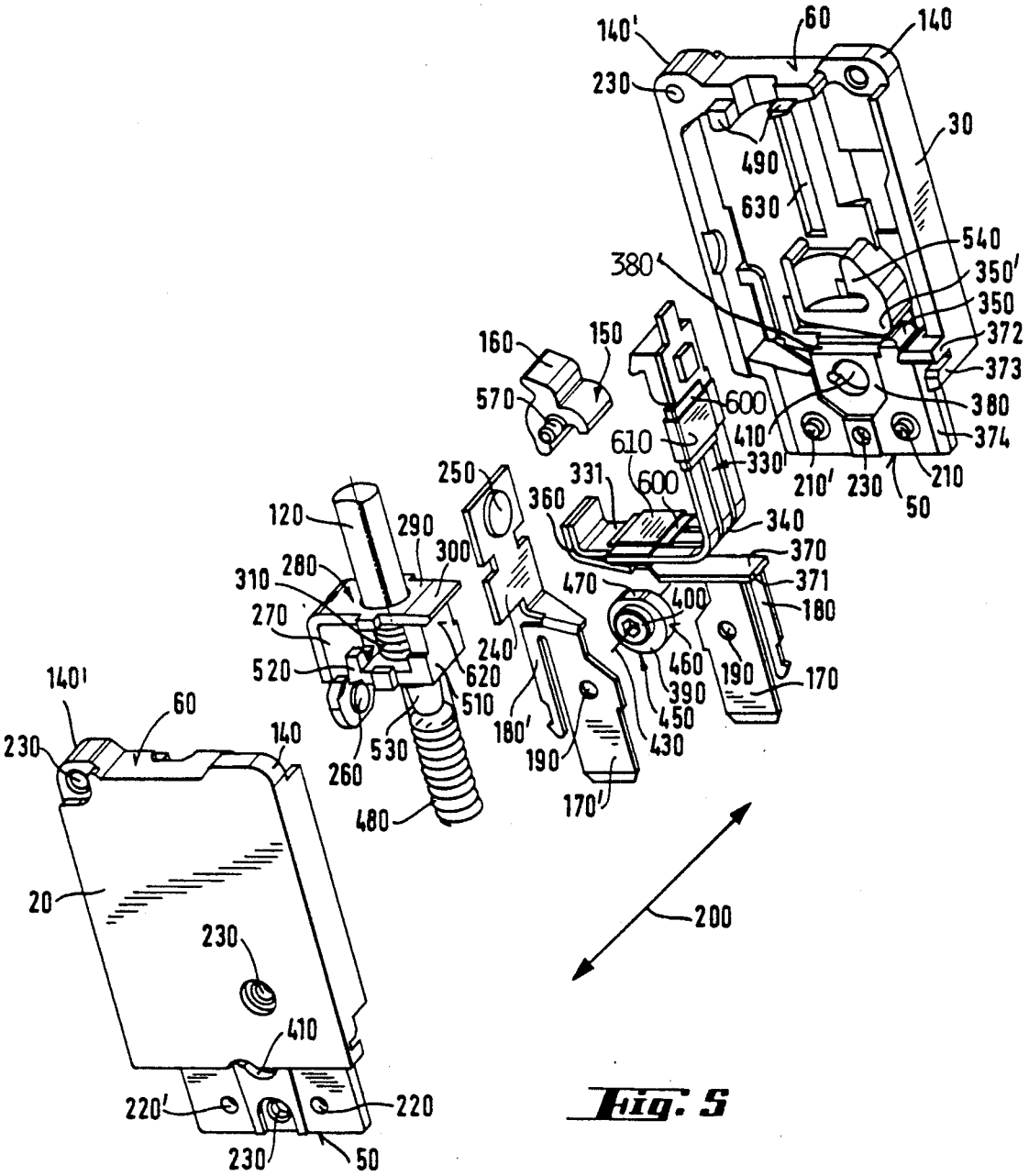
FIG. 5 shows an exploded view of another embodiment of the circuit breaker switch of FIG. 1 with a meander-shaped bimetal strip.
Figure 6:
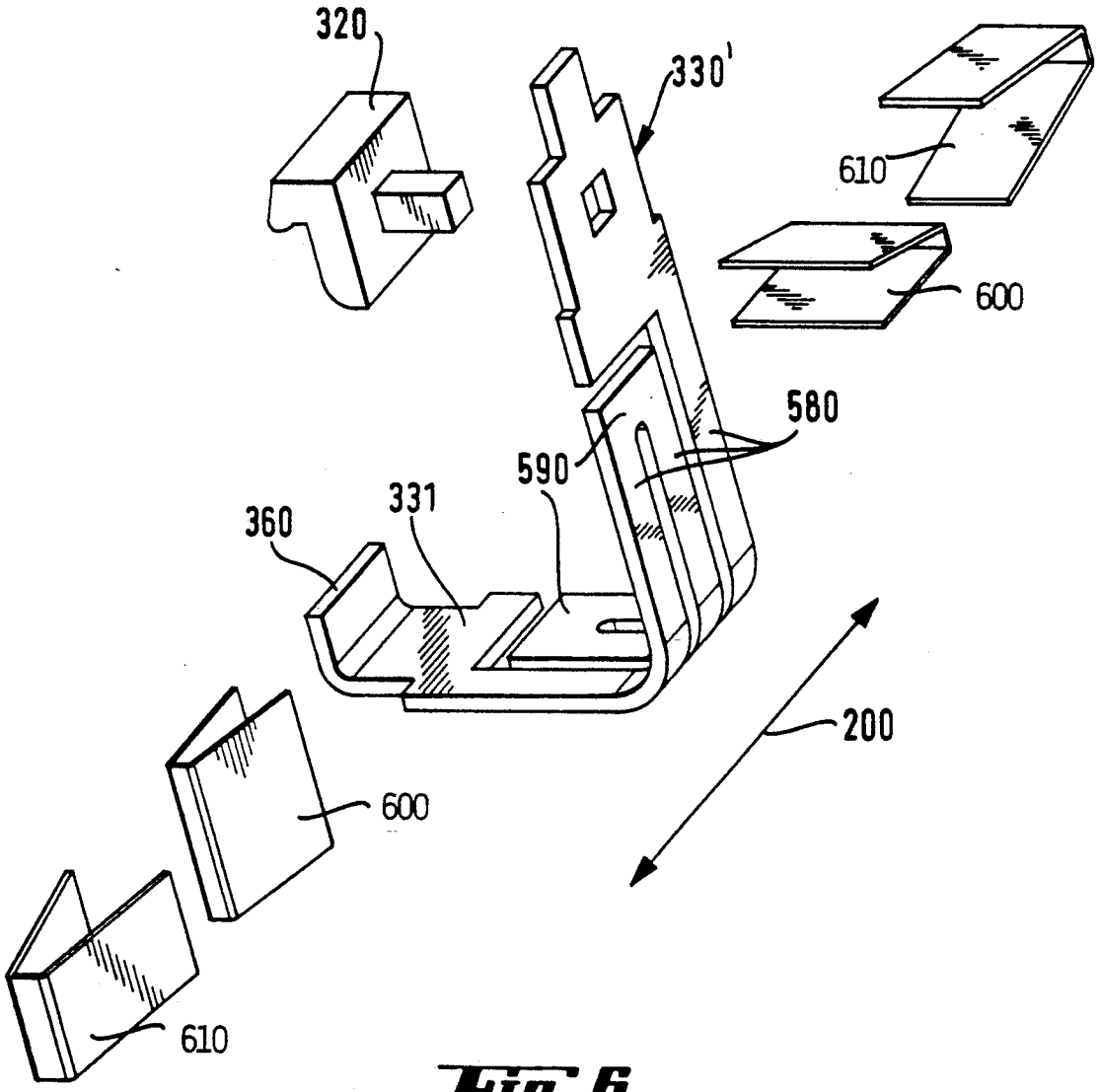
FIG. 6 is an exploded view showing detail of the meander-shaped bimetal strip of FIG. 5.

In another embodiment of circuit breaker 10, bimetal strip 330 may be configured as a meander shaped bimetal strip 330' (see FIGS. 5 and 6). In this embodiment, several bimetal strips 580 extend parallel next to one another in fixing direction 200. These juxtaposed bimetal strips 580 are electrically connected with one another by way of reversal points 590. With respect to the circuit, this produces the effect of an overly long bimetal strip 330' and a resulting correspondingly large resistance. This large resistance takes care that the necessary heating power is realized to heat the bimetal at the occurrence of small and very small currents.

In order to ensure the mechanical characteristics required for the adjustment by way of adjustment eccentric 450, metal clamps 600 having a U-shaped cross section are pushed over bimetal strip 330' in fixing direction 200 in the region of reversal points 590 in the manner of bandages. Metal clamps 600 in turn are electrically shielded against connecting arm 370 and compression spring 310, respectively, as well as tripping spring 480 by insulating clamps 610 which likewise have a U-shaped cross section and are pushed onto metal clamps 600. Metal clamps 600 enclose bimetal strip 330' so tightly that the effect of force on bimetal strip 330' is the same as for a "compact," one-piece bimetal strip 330.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a thermally trippable circuit breaker switch, a combination comprising:

a switch housing having a longitudinal axis, a narrow connection side and a lateral direction extending in a lengthwise direction of said narrow connection side perpendicular to the longitudinal axis,;

a bimetal strip disposed in said switch housing and constituting a tripping element;

a connecting arm disposed in said switch housing and extending in the lateral direction of said switch housing, said connecting arm having a free end which is clamped into said switch housing, and said connecting arm being rigidly connected with said bimetal strip for acting as a lever arm for displacing said bimetal strip;

two connecting contact elements projecting in parallel from the narrow connection side of said switch housing and extending at essentially a right angle to said connecting arm; and a rotary body made of insulating material for adjusting the tripping sensitivity of said bimetal strip, said rotary body having a cylindrical exterior surface which lies at said connecting arm and which includes a flattened portion to fix a zero position of said rotary body relative to said connecting arm, said rotary body being eccentrically rotatably mounted in said switch housing and including means for rotationally moving said rotary body from a location which is exterior of said switch housing, said rotary body lying in said switch housing without projecting therefrom and without enlarging the operative width of said switch housing, and said rotary body lying between said connecting contact elements and said connecting arm, said connecting contact elements having regions flanking said rotary body without contact, with the regions of said connecting contact elements flanking said rotary body being provided with recesses which reduce the width of said connecting contact elements in said regions.

2. The combination according to claim 1, wherein said connecting contact elements define a plane and said bimetal strip, said connecting arm and said rotary body all move approximately in the plane defined by said connecting contact elements.

3. The combination according to claim 1, wherein said connecting contact elements comprise flat knife blade lugs.

4. The combination according to claim 1, wherein said connecting contact elements have outer longitudinal sides which face away from one another, and said switch further comprises spring hooks projecting from the connection side of said switch housing and flanking said connecting contact elements at said outer longitudinal sides for latching said switch to a plug base.

5. The combination according to claim 1, wherein said connecting arm has a bent end region opposite to the free end of said connecting arm and said bimetal strip has the shape of the letter U lying in its plane of movement, with the U-shaped bimetal strip having U-legs of different lengths and a U-bar portion connected to said U-legs, said U-bar portion extending in the lateral direction of said switch housing parallel to said connecting arm, and the shorter one of said U-legs extending in a direction generally parallel the longitudinal axis of said switch housing and being fixed to the bent end region of said connecting arm which is oriented parallel to the shorter one of said U-legs.

6. The combination according to claim 5, wherein said switch has a tripping direction which is opposite to the direction of projection of said connecting contact elements and the longer one of the U-legs of said bimetal strip has an interior side facing the shorter one of said U-legs; and said switch further comprises:

a contact lug shaped to the interior side of said longer U-leg;

a tripping spring mounted in said switch housing; and an L-shaped contact bridge having a first leg and a second leg connected at an approximately right-angle to said first leg, said contact bridge being mounted in said switch housing to be pivotal approximately in the plane of movement of said bimetal strip, said first leg being disposed in the lateral direction of said switch housing in a turn-on position of said switch and having a free end including a contact piece which, in the turn-on position of said switch, is urged in the tripping direction by said tripping spring to lie against the contact lug shaped to said longer U-leg.

7. The combination according to claim 6, wherein the second leg of said contact bridge lies in a region of said switch housing which is left free by the shorter U-leg of said bimetal strip.

8. The combination according claim 7, wherein said switch has a turn-on direction in the direction of projection of said connecting contact elements, and said switch further comprise:

a supporting base shaped to said switch housing and including a switch side bead projection projecting from said supporting base in the turn-on direction of said switch; and a connection side bead projection shaped to said switch housing and lying as an abutment between said bimetal strip and said connection arm;

wherein the U-bar portion of said bimetal strip, at a region close to its transition to said longer U-leg, is held between said switch side bead projection and said connection side bead projection.

9. The combination according to claim 1, and further comprising two cheeks shaped to said switch housing and projecting into the interior of said switch housing in a direction perpendicular to both the lateral direction and the longitudinal axis, one of said cheeks being adjacent the connection side of said switch housing and the other of said cheeks being remote from the connection side of said switch housing, with said connecting arm being clamped between said two cheeks.

10. The combination according to claim 9, wherein said switch housing comprises two half shells made of injection molded plastic, with said cheeks being injection molded to one of said half shells.

11. The combination according claim 10, and wherein said rotary body has opposite sides and said switch further comprises cylindrical pivot pins eccentrically attached to the opposite sides, respectively, of said rotary body, said cylindrical pivot pins being mounted in said two housing half shells, respectively, to form an axis of rotation for said rotary body.

12. The combination according to claim 11, wherein at least one of said pivot pins has an end face including a recess shaped for engagement of a tool for adjusting the rotational position of said rotary body.

13. The combination according to claim 12 wherein said recess is shaped for engagement with a hexagonal socket tool.

14. The combination according to claim 11, wherein at least one of said the pivot pins has a circumference including radially projecting teeth in the manner of a toothed wheel.

15. The combination according to claim 14, wherein at least one of said housing half shells includes a bearing eye having a periphery including a detent for engagement in the teeth of said at least one toothed wheel shaped pivot pin.

16. The combination according to claim 15, wherein said detent projects into said bearing eye in the lateral direction of said switch housing.

17. The combination according to claim 10, wherein a trough-shaped recess for said rotary body and flat recesses to accommodate said connecting contact elements are shaped into each one of said two half shells.

18. The combination according to claim 10, wherein said connecting contact elements have outer longitudinal sides which face away from one another; and said switch further comprises spring hooks projecting from the connection side of said switch housing and flanking said connecting contact elements at said outer longitudinal sides for latching said switch to a plug base, with one of said connecting contacts elements, said connecting arm and one of said spring hooks adjacent to said one connecting contact element being made of one piece, and with one of said housing half shells including a shaped on housing rib lying in a space between said one connecting contact element and said one spring hook.

19. The combination according to claim 18, wherein said connecting arm, said one connecting contact element and said one spring hook form a $\pi$-shaped component in the plane defined by said two connecting contact elements, with said connecting arm forming the transverse yoke of said $\pi$-shaped component.

20. The combination according to claim 19, wherein a trough-shaped recess for said rotary body and flat recesses to accommodate said connecting contact elements are shaped into each one of said two half shells, said connecting contact elements each have an inner longitudinal side facing one another, the trough-shaped recess flanks the inner sides of said connecting contact elements, said cheek on the connection side of said switch housing flanks a side of said one spring hook, and said trough-shaped recess, said rib and said one cheek on the connection side form a form-locking fixed support for said $\pi$-shaped component effective in the lateral direction of said switch housing.

21. The combination according to claim 19, wherein said switch has a turn-on direction in the direction of projection of said connecting contact elements, and said switch further comprises:

a supporting base shaped to said switch housing and including a switch side bead projection projecting from said supporting base in the turn-on direction of said switch; and a connection side bead projection shaped to said switch housing and lying as an abutment between said bimetal strip and said connection arm; wherein the U-bar portion of said bimetal strip, at a region close to its transition to said longer U-leg, is held between said switch side bead projection and said connection side bead projection; and said rib has an end face facing away from the direction of projection of said connecting contact elements, and said two cheeks, the end face of said rib and said bead projection on the connection side of said switch form a form-locking fixed support for said $\pi$-shaped component in a direction parallel to the longitudinal axis.

22. The combination according to claim 1, wherein said rotary body comprises a disc having a small wall thickness.

23. The combination according to claim 1, wherein said bimetal strip comprises a plurality of juxtaposed bimetal strips which are electrically connected in series.

24. The combination according to claim 23, and further comprising a clamp disposed for gripping said juxtaposed bimetal strips for combining said juxtaposed bimetal strips into a one-piece bimetal band.

25. The combination according to claim 1, wherein said bimetal strip is configured as a meander-shaped bimetal strip.

* * * * *